US006971594B1

(12) United States Patent
Polifka

(10) Patent No.: US 6,971,594 B1
(45) Date of Patent: Dec. 6, 2005

(54) APPARATUS AND METHOD FOR CIRCULAR VORTEX AIR FLOW MATERIAL GRINDING

(75) Inventor: Francis D. Polifka, Hays, KS (US)

(73) Assignee: Vortex Dehydration Technology, LLC, Hanover, MD (US)

( * ) Notice: Subject to any disclaimer, the term of this patent is extended or adjusted under 35 U.S.C. 154(b) by 0 days.

(21) Appl. No.: 09/719,846

(22) PCT Filed: Mar. 16, 2000

(86) PCT No.: PCT/US00/06853

§ 371 (c)(1),
(2), (4) Date: Dec. 15, 2000

(87) PCT Pub. No.: WO00/56460

PCT Pub. Date: Sep. 28, 2000

Related U.S. Application Data

(60) Provisional application No. 60/125,570, filed on Mar. 23, 1999.

(51) Int. Cl.[7] ..... B02C 19/06
(52) U.S. Cl. ..... 241/5; 241/39
(58) Field of Search ..... 241/5, 39, 12, 241/60, 48

(56) References Cited

U.S. PATENT DOCUMENTS

| | | | | |
|---|---|---|---|---|
| 1,123,033 A | | 12/1914 | Stobie | |
| 2,316,207 A | | 4/1943 | Winter | 34/10 |
| 2,362,351 A | | 11/1944 | Burmeister et al. | 43/147 |
| 2,390,678 A | | 12/1945 | Andrews | 241/5 |
| 2,562,753 A | | 7/1951 | Trost | 241/39 |
| 2,690,880 A | | 10/1954 | Chatelain | 241/39 |
| 2,958,472 A | * | 11/1960 | Erickson et al. | 241/39 |
| 3,058,674 A | | 10/1962 | Kocher | 241/39 |
| 3,726,484 A | | 4/1973 | Schurr | 241/5 |
| 4,248,387 A | | 2/1981 | Andrews | 241/5 |
| 4,280,664 A | | 7/1981 | Jackson et al. | 241/39 |
| 5,012,619 A | | 5/1991 | Knepprath et al. | 51/163.1 |
| 5,236,132 A | * | 8/1993 | Rowley, Jr. | 241/5 |
| 6,394,371 B1 | * | 5/2002 | Ribardi | 241/5 |

FOREIGN PATENT DOCUMENTS

| | | |
|---|---|---|
| FR | 778415 | 3/1935 |
| IT | 328386 | 8/1935 |

OTHER PUBLICATIONS

Frank Garofalo,"The Wichita Eagle", p. 3A and from p. 1A (Invention).

* cited by examiner

*Primary Examiner*—W. Donald Bray
(74) *Attorney, Agent, or Firm*—Dorsey & Whitney LLP

(57) ABSTRACT

A material grinding apparatus (10) includes an annular upper enclosure (12) defining an upper chamber (34) into which material to be ground is introduced from above, a conical lower enclosure (14) defining a lower chamber (36) and supported in tandem with the upper enclosure (12), and one or more angled slots (56) defined in the sidewall of the upper enclosure (12) through which compressed air is introduced relatively circumferentially into the upper chamber (34) so as to generate a circular vortex flow of air and material in the upper enclosure (12) for grinding and drying to take place. The air flow is exhausted by a pipe (92) through an upper end of the upper enclosure (12) and the dried ground material is discharged through an open lower end of the lower enclosure (14). The lower enclosure (14) is a downward continuation and extension of the upper enclosure (12) so as not to extend upwardly into nor past the upper chamber (34) thereof.

44 Claims, 3 Drawing Sheets

APPARATUS AND METHOD FOR CIRCULAR VORTEX AIR FLOW MATERIAL GRINDING

This application claims the benefit of provisional application No. 60/125,570 filed Mar. 23, 1999.

TECHNICAL FIELD

The present invention generally relates to material grinding and, more particularly, is concerned with an apparatus and method for circular vortex air flow material grinding.

BACKGROUND ART

Landfills often have limited space. In order to reduce the volume of space which discarded materials occupy in landfills, it is generally desirable to have an apparatus capable of grinding diverse materials typically disposed of in landfills. Two approaches have employed air in the grinding process. One approach involves the use of a large volume of air which is generated by a fan. The other approach involves the use of air at high velocity instead of large volume. A variety of grinding devices using air have been developed over the years.

Representative examples of such prior art grinding devices and the like are disclosed in U.S. Pat. No. 1,123,033 to Stobie, U.S. Pat. No. 2,362,351 to Burmeister et al., U.S. Pat. No. 2,562,753 to Trost, U.S. Pat. No. 2,690,880 to Chatelain, U.S. Pat. No. 3,058,674 to Kocher, U.S. Pat. No. 4,248,387 to Andrews, U.S. Pat. No. 4,280,664 to Jackson et al., U.S. Pat. No. 5,012,619 to Knepprath et al., French Pat. No. 778,415 to International Pulverizing Corporation and German Pat. No. 328,386 to Aktiengesellschaft. The Trost patent uses air velocity in the grinding process. The Trost patent discloses an anvil grinder which includes a cyclone chamber in communication with a grinding chamber. An upper portion of the cyclone chamber extends upwardly through the grinding chamber such that the grinding chamber surrounds an upper end of the cyclone chamber but is separated therefrom. Only the upper ends of the grinding and cyclone chamber are in communication along an upper passageway extending around and above the entrance to an air offtake stack. Problems exist with this arrangement in that the upper portion of the cyclone chamber is cylindrical shaped and separated from the grinding chamber so it does not augment a vortex air flow created in the grinding chamber. The ground material must drastically change its direction of movement and be entrained in the air flow to go from the grinding chamber to the cyclone chamber in order to rise over the upper end of the cyclone chamber.

Consequently, a need remains for a material grinding apparatus which overcomes the aforementioned problems associated with the prior art design without introducing any new problems in place thereof.

DISCLOSURE OF INVENTION

The present invention provides an apparatus and method for compressed air vortex flow material grinding designed to satisfy the aforementioned need. The grinding apparatus of the present invention uses high velocity compressed air in the grinding process for grinding, and also drying, diverse materials including by way of examples, but not limited to, glass, grain, paper, plastic, aluminum and granite. The grinding apparatus includes an annular upper enclosure defining an upper chamber into which material to be ground is introduced, a conical lower enclosure defining a lower chamber provided in tandem with the upper enclosure and one or more holes defined in the upper enclosure for introducing compressed air that generates a relatively high velocity vortex flow of air and material in the upper enclosure for grinding and drying to take place. The conical lower enclosure is a downward continuation and extension of the annular upper enclosure. The lower enclosure does not extend upwardly into nor past the upper chamber of the upper enclosure.

Accordingly, the present invention is directed to a material grinding apparatus which comprises: (a) an upper enclosure including an upper annular sidewall, an upper end, open lower end and opposite exterior and interior sides, the upper annular sidewall defining an upper interior chamber at the interior side of the upper enclosure and having at least one hole of a predetermined size formed therethrough between the exterior and interior sides thereof providing flow communication between the exterior side of the upper enclosure and the upper interior chamber thereof; (b) a lower enclosure disposed below and in tandem with the upper enclosure, the lower enclosure including a lower annular sidewall having a substantially inverted conical configuration and open upper and lower ends and defining a lower interior chamber, the lower annular sidewall of the lower enclosure being mounted at the open upper end thereof to the open lower end of the upper enclosure such that the lower annular sidewall and lower interior chamber of the lower enclosure is substantially continuous from and in flow communication with the upper annular sidewall and upper interior chamber of the upper enclosure; (c) means for delivering material to be ground into the upper interior chamber of the upper enclosure through the upper end thereof; (d) means for supplying a flow of air, such as in a compressed state, through the hole in the upper annular sidewall of the upper enclosure into the upper interior chamber thereof to along a flow path extending about the interior side of the upper annular sidewall of the upper enclosure; and (e) means for exhausting air from the upper interior chamber of the upper enclosure through the upper end thereof such that the means for supplying air and the means for exhausting air coact with the hole in the upper annular sidewall and with the upper and interior chambers to create a circular vortex flow of air within the upper and lower interior chambers of the upper and lower enclosures that causes grinding and drying of material substantially in the upper interior chamber of the upper enclosure, exhausting of air from the upper interior chamber of the upper enclosure through the upper end thereof, downward travel of ground material through the lower interior chamber of the lower enclosure and downward discharge of the ground material from the lower interior chamber through the open lower end of the lower enclosure, the lower interior chamber of the lower enclosure having an inverted conical shape which augments the circular vortex flow of air and material in the upper and lower interior chambers of the upper and lower enclosures. The apparatus also comprises a support structure supporting the upper and lower enclosures in an upright orientation with the upper enclosure above the lower enclosure such that the upper and lower enclosures and their upper and lower interior chambers are in a tandem orientation with one another.

More particularly, the hole through the upper annular sidewall of the upper enclosure is a slot having a height oriented so as to extend between and in a generally transverse relationship to the upper and lower ends of the upper enclosure and a length oriented so as to extend between and at an acute angle relative to the exterior and interior sides of the upper enclosure. The upper enclosure further includes means disposed along the exterior side thereof for adjusting the width of the vertical slot. The slot width adjusting means includes a plate and a releasable fastening arrangement mounting the plate to the upper annular sidewall at the exterior side of the upper enclosure adjacent to the hole for undergoing slidable movement in relation to the upper annular sidewall and the hole therethrough for varying the effective width of the hole through which the flow of air can pass. The upper enclosure further includes a deflection plate mounted to the upper annular sidewall at the interior side of the upper enclosure adjacent to the hole through the upper annular sidewall and defining an angular configuration relative to the upper annular sidewall for deflecting air away from the hole so as to not disrupt the air flowing from the hole into the upper interior chamber of the upper enclosure. The means for supplying air includes a manifold mounted to the upper annular sidewall of the upper enclosure on the exterior side thereof and defining an air collection cavity enclosing and disposed in flow communication with the hole through the upper annular sidewall of the upper enclosure. The manifold has an air supply inlet. At least one tube extends from an external source of compressed air and is connected to and in flow communication with the air supply inlet of the manifold such that air in the compressed state passes through the tube, through the air supply inlet of the manifold, into and through the air collection cavity of the manifold, through the hole of the upper enclosure and into the upper interior chamber of the upper enclosure.

The means for exhausting air from the upper interior chamber of the upper enclosure includes an exhaust pipe having an open upper end and an open lower end and being mounted to and disposed through the upper end of the upper enclosure such that the open upper end of the exhaust pipe is disposed externally of and above the upper enclosure and the open lower end of the exhaust pipe is disposed within and in flow communication with the upper interior chamber of the upper enclosure. The open lower end of the exhaust pipe is located closer to the open lower end of the upper enclosure than to the upper end thereof. The exhaust pipe also has an upper side opening disposed externally of and above the upper enclosure and a lower side opening disposed within and in flow communication with the upper interior chamber of the upper enclosure. The means for delivering material to be ground into the upper interior chamber of the upper enclosure includes a feed tube having an open upper end and an open lower end and being mounted to and disposed through the upper and lower sides openings of the exhaust pipe such that the open upper end of the feed tube is disposed externally of the upper enclosure and adjacent to a side of the exhaust pipe and the open lower end of the feed tube is disposed internally of the upper enclosure and adjacent to an opposite side of the exhaust pipe and within and in flow communication with the upper interior chamber of the upper enclosure such that material to be ground can be fed via the feed tube across the exhaust pipe from exteriorly of the upper enclosure into the circular vortex flow of air in the upper interior chamber of the upper enclosure.

The present invention also is directed to a material grinding method which comprises the steps of: (a) providing an upper enclosure with at least one hole of a predetermined size formed therethrough between exterior and interior sides thereof and oriented so as to extend between and at an acute angle relative to the exterior and interior sides so as to provide flow communication between the exterior side thereof and an upper interior chamber thereof; (b) providing a lower enclosure below and in tandem with the upper enclosure and having an inverted conical configuration such that an lower interior chamber of the lower enclosure is substantially continuous and in flow communication with the upper interior chamber of the upper enclosure; (c) delivering material to be ground into the upper interior chamber of the upper enclosure through an upper end thereof; (d) supplying a flow of air, such as in a compressed state, through the hole in the upper enclosure into the upper interior chamber thereof to along a flow path extending about the interior side of the upper enclosure; and (e) exhausting air from the upper interior chamber of the upper enclosure through the upper end thereof such that the supplying of air and the exhausting of air coact with the hole in the upper enclosure and with the upper and interior chambers to create a circular vortex flow of air within the upper and lower interior chambers of the upper and lower enclosures that causes grinding and drying of material substantially in the upper interior chamber of the upper enclosure, downward travel of ground material through the lower interior chamber of the lower enclosure and downward discharge of the ground material from the lower interior chamber of the lower enclosure through an open lower end thereof, the lower interior chamber of the lower enclosure being provided with an inverted conical shape which augments the circular vortex flow of air and material in the upper and lower interior chambers of the upper and lower enclosures.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

BEST MODE FOR CARRYING OUT THE INVENTION

Figure 1:
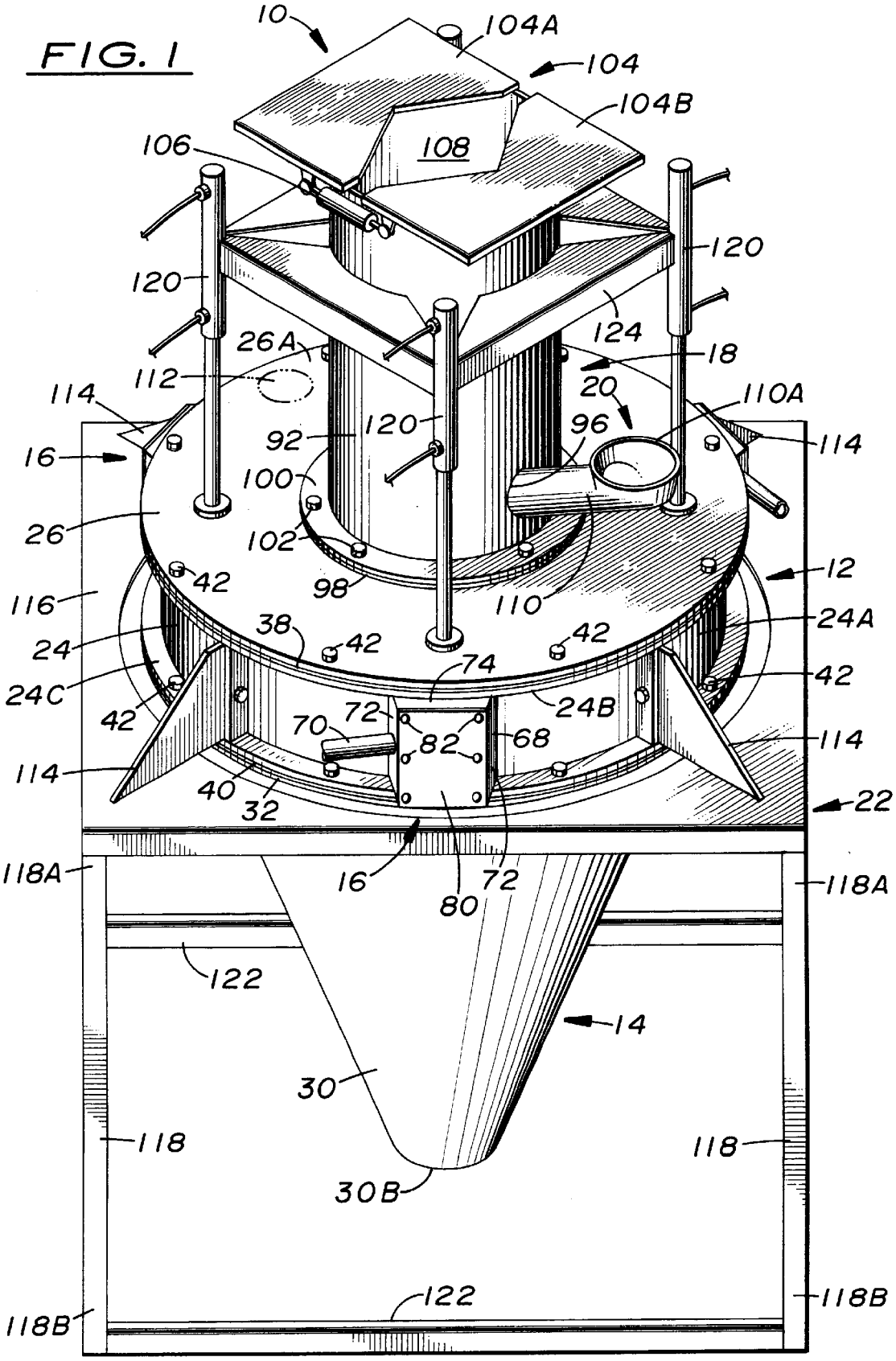
FIG. 1 is a perspective view of a material grinding apparatus of the present invention.
Figure 2:
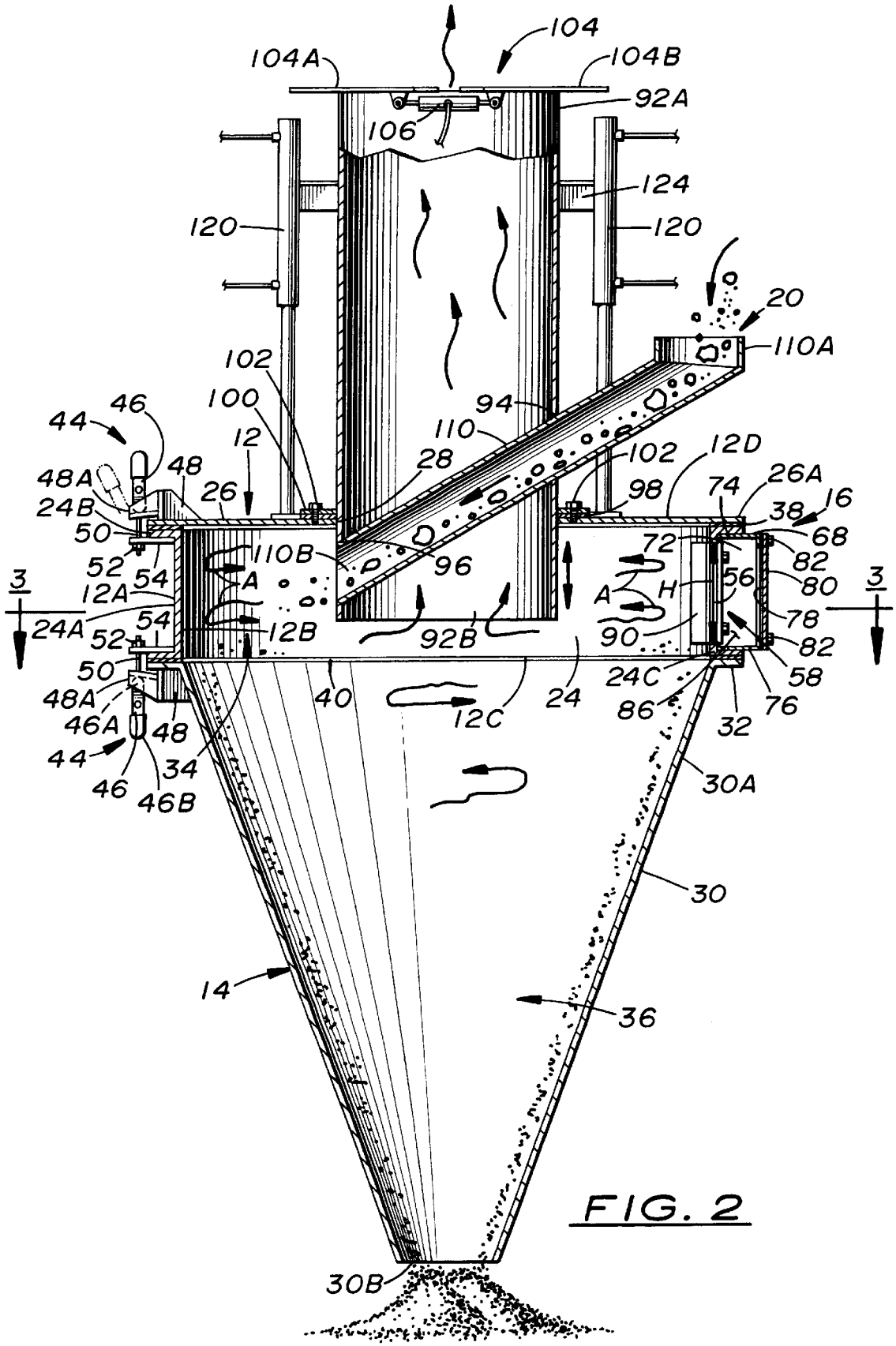
FIG. 2 is a vertical sectional view of the grinding apparatus with arrows indicating the flow of air.
Figure 3:
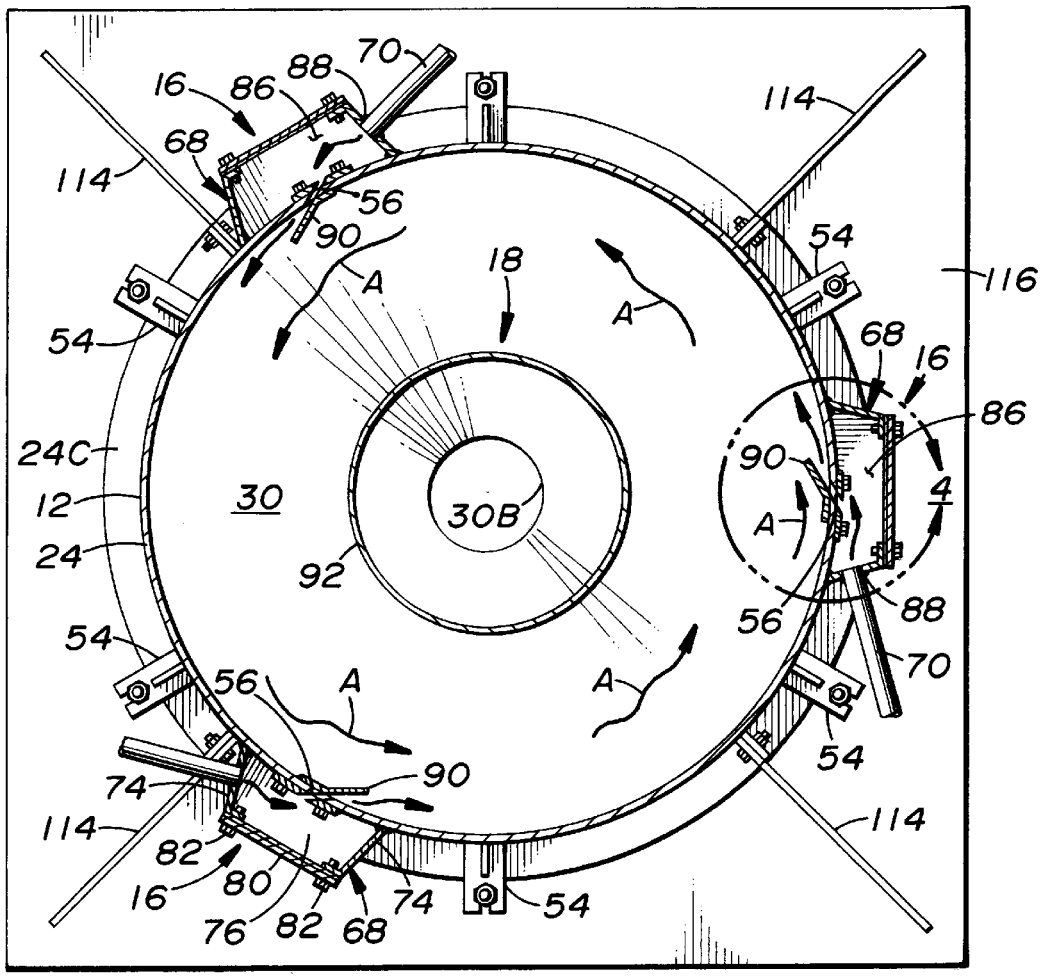
FIG. 3 is a horizontal sectional view of the grinding apparatus taken along line 3—3 of FIG. 2 with arrows indicating the flow of air.

Referring to the drawings, and particularly to FIGS. 1 to 3, there is illustrated a material grinding apparatus, generally designated 10, of the present invention. The grinding apparatus 10 basically includes an upper enclosure 12, a lower enclosure 14, an air supplying means 16, an air exhausting means 18 and a material delivering means 20. The grinding apparatus 10 also includes a support structure 22 supporting the upper and lower enclosures 12, 14 in an upright tandem orientation.

Referring to FIGS. 1 to 5, the upper enclosure 12 includes a continuous upper annular sidewall 24 and has opposite exterior and interior sides 12A, 12B, an open lower end 12C and a closed upper end 12D. Its closed upper end 12D is provided preferably in the form of a top cover 26 removably mounted on and overlying the upper annular sidewall 24. The upper annular side wall 24 has a main annular wall portion 24A of substantially cylindrical configuration and upper and lower annular lip portions 24B, 24C being substantially identical to one another. The upper and lower annular lip portions 24B, 24C are rigidly fixed to upper and lower opposite open ends of the main annular wall portion 24A and extending substantially perpendicularly and outwardly therefrom. The top cover 26 has a substantially rigid flat disc-like configuration and is supported at its peripheral edge portion 26A upon the upper annular lip portion 24B of the upper annular sidewall 24 so as to overlie and close the open upper end of the main annular wall portion 24A of the upper annular sidewall 24 and thus the upper end 12D of the upper enclosure 12. The top cover 26 has defined therethrough a central opening 28 of a substantially circular configuration.

Referring now to FIGS. 1 to 3, the lower enclosure 14 in the form of a continuous lower annular sidewall 30. The lower annular sidewall 30 has a substantially inverted truncated conical configuration and opposite open upper and lower ends 30A, 30B. The open upper end 30A of the lower annular sidewall 30 has a diameter which is substantially greater than the diameter of the open lower end 30B thereof and substantially the same as the diameter of the upper annular sidewall 24 at the lower end 12C of the upper enclosure 12. The lower annular sidewall 30 has an upper annular lip 32 which is rigidly fixed to the open upper end 30A of the lower annular sidewall 30 and extends substantially perpendicularly and outwardly therefrom. The lower annular sidewall 30 at the upper annular lip 32 thereof is mounted to the lower annular lip portion 24C of the upper annular sidewall 24 such that the upper annular sidewall 24 of the upper enclosure 12 and the lower annular side wall 30 of the lower enclosure 14 are substantially continuous with one another.

The upper enclosure 12 at the interior side 12B thereof defines an upper interior chamber 34 within the upper annular sidewall 24, below the top cover 24 and above the open lower end 12C of the upper enclosure 12. The lower enclosure 14 defines a lower interior chamber 36 within the lower annular sidewall 30 and between the open upper and lower ends 30A, 30B thereof. The lower interior chamber 36 of the lower enclosure 14 is disposed substantially continuous from and in flow communication with the upper interior chamber 34 of the upper enclosure 12. The upper annular sidewall 24 and the top cover 26 of the upper enclosure 12 and the lower annular sidewall 30 of the lower enclosure 14 are made of the same heavy metal material to ensure a relatively long wear life for the upper and lower enclosures 12, 14.

The upper annular sidewall 24 and top cover 26 of the upper enclosure 12 at their respective upper annular lip portion 24B and peripheral edge portion 26A are sealably secured together by an upper annular seal 38 clamped therebetween and a plurality of fasteners extending between and interconnecting the upper annular lip portion 24B and the peripheral edge portion 26A at locations circumferentially spaced apart about the upper enclosure 12. The upper annular sidewall 24 and lower annular sidewall 30 at their respective lower annular lip portion 24C and upper annular lip portion 32 are sealably secured together by a lower annular seal 40 clamped therebetween and a plurality of fasteners extending between and interconnecting the lower annular lip portion 24C and upper annular lip portion 32 at locations spaced apart circumferentially about the upper and lower enclosures 12, 14. The upper and lower annular seals 38, 40 are substantially identical to one another and have substantially circular configurations. They provide respective air-tight seals between the upper annular sidewall 24 and top cover 26 of the upper enclosure 12 and the upper and lower annular sidewalls 24, 30 of the upper and lower enclosures 12, 14. Each fastener can be of any conventional form per se, such as a bolt 42 as seen in FIG. 1, or, alternatively, an overcenter toggle clamp 44 as seen in FIGS. 2 and 3. The overcenter toggle clamps 44 function in a manner that is well-known to releasably clamp and lock the upper annular sidewall 24 and top cover 26 together and the upper and lower annular sidewalls 24, 30 together. Each overcenter toggle clamp 44 includes a lever 46 pivotally mounted at one end 46A to an outer end 48A of a bracket 48 fixedly attached on respective ones of the peripheral edge portion 26A of the top cover and upper annular lip portion 32 of the lower annular sidewall 30, a bolt 50 pivotally mounted at one end to the lever 46 between the opposite ends 46A, 46B thereof and having a nut 52 applied on the other end of the bolt 50. When the lever 46 is pivoted to an overcenter locked vertical position, as seen in solid line form in FIG. 2, the bolt 50 extends through a notch in another bracket 54 attached to and projecting outwardly from respective ones of the upper and lower lip portions 24B, 24C of the upper annular sidewall 24 and the nut 52 on the bolt 50 is disposed on an opposite side of the bracket 54 from the lever 46. When the lever 46 is pivoted outwardly from the overcenter locked position to a released position, as seen in dashed line form in FIG. 2, the bolt and its nut (not shown) are released from engagement with the bracket 54.

Referring again to FIGS. 1 to 5, the upper enclosure 12 has at least one and, preferably, a plurality of air holes 56, such as three in number, formed through the main annular wall portion 24A of the upper annular side wall 24 of the upper enclosure 12 and open at each of the exterior and interior sides 12A, 12B thereof. The number of air holes 56 is determined by the desired diameter of the upper enclosure 12. The air holes 56 can be substantially identical to one another, although they need not be so. The air holes 56 are circumferentially spaced apart, such as through equal distances, from one another. Each air hole 56 preferably is in the form of a vertical slot having a vertical height H (FIG. 2) oriented so as to extend between and in a generally transverse relationship to the upper and lower ends 12D, 12C of the upper enclosure 12 and a length L (FIG. 3) oriented so as to extend between and at an acute angle relative to the exterior and interior sides 12A, 12B of the upper enclosure 12. The height H of each hole 56 is substantially greater than the length L and a width W thereof. The formation of each air hole 56 so as to extend at the acute angle through the upper annular sidewall 24 creates a substantially tangential circular flow pattern in the upper interior chamber 34 of the upper enclosure 12, as depicted by the arrows A in FIGS. 1 and 3.

Figure 4:
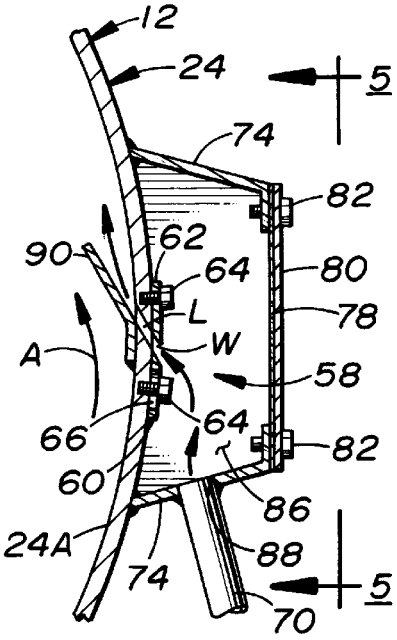
FIG. 4 is an enlarged detailed view of a manifold and an air tube of an air supplying means of the grinding apparatus enclosed by circle 4 of FIG. 3 with arrows indicating the flow of air.
Figure 5:
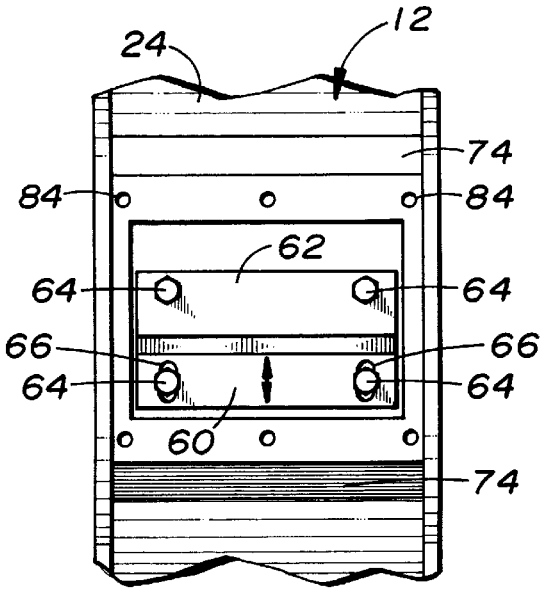
FIG. 5 is a side elevational view of an air hole width adjusting means as seen along line 5—5 of FIG. 4 with a front cover of the manifold of the air supplying means removed.

The upper enclosure 12 also includes a plurality of means 58 for adjusting the effective width W of each air holes 56. The width adjusting means 58 includes a pair of plates 60, 62 and a plurality of fasteners 64, such as bolts. More particularly, there is one adjustable plate 60, one stationary plate 62 and four fasteners 64 for each air hole 56, as shown in FIGS. 4 and 5. The adjustable and stationary plates 60, 62 have the same size. The stationary plate 62 is fixedly mounted to the upper annular sidewall 24 of the upper enclosure 12 at the exterior side 12A thereof on one side of the adjacent air hole 56. The adjustable plate 60 is slidably mounted the upper annular sidewall 24 on an opposite side of the adjacent air hole 56 and, upon loosening of two of bolts 64, can undergo slidable movement toward and away from the stationary plate 62 relative to the upper annular sidewall 24 and the hole 56 therethrough to vary the effective width W of the adjacent air hole 56. The movement of the adjustable plate 60 in the opposite directions causes the orifice or spacing between the adjustable and stationary plates 60, 62 aligned with the hole 56 to correspondingly increase or decrease in size and thereby expose more or less of the adjacent air hole 56 so as to vary the effective width of the air hole 56 between facing edges 60A, 62A of the plates 60, 62 which are angled in a direction consistent with the angle of the adjacent air hole 56. The adjustable plate 60 has a pair of spaced apart slots 66 formed therethrough which are identical and parallel to one another. The two fastener 64 are received through the slots 66 and threadable into the upper annular sidewall 24. The two fasteners 64 may be tightened or loosened in relation to the adjustable plate 60 and the upper annular sidewall 24 for holding the plate 60 in place or for allowing the plate 60 to be moved along the lengths of the slots 66 through the desired amount before retightening of the fasteners 64.

The air supplying means 16 of the apparatus 10 delivers air, preferably in a compressed state, through each of the air holes 56 in the upper annular sidewall 24 and into the upper interior chamber 34 of the upper enclosure 12. The air supplying means 16 includes at least one and, preferably, a plurality of manifolds 68 and at least one and, preferably, a plurality of air tubes 70. One manifold 68 and one air tube 70 are used in conjunction with each of the air hole 56 of the upper enclosure 12. Where there are three holes 56, there will be three manifolds 68. Each manifold 68 is attached to the upper annular sidewall 24 of the upper enclosure 12 on the exterior side 12A thereof. The manifolds 68 are preferably spaced apart from one another through equal distances along the upper annular sidewall 24 of the upper enclosure 12. Each manifold 68 has a pair of opposite side walls 72, a top wall 74, a bottom wall 76, an annular seal 78, a front cover 80 and a plurality of fasteners 82, such as bolts. The side walls 72 are substantially identical to and mirror images of one another, having substantially slanted L-shaped transverse configurations. The top and bottom walls 74, 76 are substantially identical to and mirror images of one another and extend between and rigidly interconnected opposite upper and lower edges of the side walls 72. The annular seal 78 and front cover 80 have substantially rectangular configurations. The annular seal 78 is disposed and provides an air-tight seal between the periphery of the front cover 80 and adjoining edge portions of the side walls 72, top wall 74 and bottom wall 76. The front cover 80 has a plurality of spaced apart holes at the corners thereof, such as six in number, that receive the fasteners 82 which, in turn, are removably threaded into a plurality of corresponding holes 84 in the manifold 68. The front cover 80 is thereby removable for providing access to the width adjusting means 58 of the upper enclosure 12.

Each manifold 68 defines an air collection cavity 86 therein and an air supply inlet 88. The air collection cavity 86 is disposed between the upper annular sidewall 24 and the side walls 72, top wall 74, bottom wall 76 and front cover 80. The air collection cavity 86 thus encloses, overlies and is disposed in flow communication with the one adjacent air hole 56 of the upper enclosure 12. The air supply inlet 88 of the manifold 68 is circular in shape and formed through one of the side walls 72. The air supply inlet 88 also is in flow communication with the air collection cavity 86. Each air tube 70 of the air supplying means 16 has a cylindrical shape. There are three air tubes 70 matching the number of manifolds 68. Each air tube 70 extends from an external source of compressed air (not shown), such as a conventional air compressor, and is connected to and in flow communication with the air supply inlet 88 of one of the manifolds 68 such that air in a compressed state may pass through the air tube 70, through the air supply inlet 88 of the respective one manifold 68, into and through the air collection cavity 86 of the one manifold 68, through the adjacent air hole 56 of the upper enclosure 12 and into the upper interior chamber 34 of the upper enclosure 12, as shown in FIG. 4.

The upper enclosure 12 also includes at least one and, preferably, a plurality of deflection plates 90. Each deflection plate 90 has a substantially angular configuration and is mounted to the upper annular sidewall 24 of the upper enclosure 12 at the interior side 12B thereof and adjacent to a respective one of the air holes 56 of the upper enclosure 12. Each deflection plate 90 functions to slightly deflect the flow of air circulating within the upper interior chamber away from the air hole 56 as it passes the air hole 56 so as to not disrupt the incoming air flow from the hole 56 into the upper interior chamber 34 of the upper enclosure 12. The angular configuration of the deflection plate 90 provides a gap between it and the upper annular sidewall 24 to allow the maximum amount of air to flow unrestricted into the upper interior chamber 34.

Referring to FIGS. 1 to 3, the air exhausting means 18 of the apparatus 10 is provided for exhausting air from the flow thereof circulating in the upper interior chamber 34 of the upper enclosure 12. The air exhausting means 18 includes an exhaust pipe 92. The exhaust pipe 92 has a cylindrical configuration and opposite open upper and lower end 92A, 92B. The exhaust pipe 92 also has upper and lower side openings 94, 96 of substantially circular configurations disposed on opposite sides of the exhaust pipe 92. The cross-sectional size of the exhaust pipe 92 is generally determined by the combined sizes of the upper and lower interior chambers 34, 36 of the respective upper and lower enclosures 12, 14. The exhaust pipe 92 snugly fits through and is mounted to and disposed through the central opening 28 of the top cover 26 of the upper enclosure 12 such that the open upper end 92A and the upper side opening 94 of the exhaust pipe 92 are disposed externally above the upper enclosure 12 and the open lower end 92B and the lower side opening 96 of the exhaust pipe 98 are disposed within and in flow communication with the upper interior chamber 34 of the upper enclosure 12. Thus, air in the upper interior chamber 34 of the upper enclosure 12 can be exhausted into and upwardly through the exhaust pipe 92 in the direction indicated by arrows B in FIG. 2. The open lower end 92B of the exhaust pipe 92 is disposed closer to the open lower end 12B than to the closed upper end 12A of the upper enclosure 12. The open upper end 92A of the exhaust pipe 92 is disposed from the top cover 26 of the upper enclosure 12 at a distance substantially greater than the distance the open lower end 92B of the exhaust pipe 92 is disposed from the top cover 26.

The upper enclosure 12 also includes a top annular seal 98, a top annular seal cover 100 and fasteners 102. The top annular seal 98 and top annular seal cover 100 both have a substantially circular configuration. The top annular seal 98 is disposed on top of the top cover 26 around the central opening 28 therethrough, the top annular seal cover 100 is disposed on and overlies the top annular seal 100 and the fasteners 102 secure both to the top cover 26 about the central opening 28. The top annular seal 98 of the upper enclosure 12 provides an air-tight seal between the exhaust pipe 92 and the top cover 26 of the upper enclosure 12.

The apparatus 10 also includes a damper 104 mounted on the open upper end 92A of the exhaust pipe 92 and an actuator 106. The damper 104 has two half portions 104A, 104B substantially identical to and mirror images of one another. The actuator 106 interconnects the half portions 104A, 104B and is operable for moving them toward or away from one another so as to decrease or increase the size of a central space 108 therebetween. The damper 104 has an actuator 116 for causing movement of the half portions 104A, 104B. The actuator 106, which can be hydraulic or electric, is manually operated remotely. The damper 104 is thereby mounted upon the exhaust pipe 92 at the upper end 92A thereof and operable for regulating the flow of air from the upper and lower interior chambers 34, 36 of the respective upper and lower enclosures 12, 20 through the exhaust pipe 98 of the air exhausting means 16 and thereby for regulating the size to which the material is ground in the upper and lower chambers 34, 36 of the upper and lower enclosures 12, 14, as shown diagrammatically in FIG. 1. The damper 104 can be adjusted to permit lighter material to be retained longer in the upper and lower interior chambers 34, 36 of the upper and lower enclosures 12, 14 for more complete grinding of the material.

Referring to FIGS. 1 and 2, the material delivering means 20 of the apparatus 10 is for delivering material to be ground to the upper interior chamber 34 of the upper enclosure 12. The material delivering means 20 includes a feed tube 110 of a substantially cylindrical configuration. The feed tube 110 has opposite open upper and lower ends 110A, 110B. The upper end 110A of the feed tube 110 can be in the form of a hopper or the like for receiving the material to be ground feed thereto by any suitable means, such as manually, by vacuum or the discharge end of a material elevator or auger. The feed tube 110 is mounted to the exhaust tube 92 and disposed through the upper and lower side openings 94, 96 of the exhaust pipe 92 such that the open upper end 110A of the feed tube 110 is disposed externally to the upper enclosure 12 and the exhaust pipe 92 whereas the open lower end 110B of the feed tube 110 is disposed in and in flow communication with the upper interior chamber 34 of the upper enclosure 12 such that material to be ground can be fed via the feed tube 110 across the exhaust pipe 92 from exteriorly of the upper enclosure 12 into the circular vortex flow of air in the upper interior chamber 34 of the upper enclosure 12. The feed tube 110 is disposed at an acute angle relative to the top cover 26 of the upper enclosure 12. The material to be ground is fed into the feed tube 110 after the compressed air is delivered into the upper interior chamber 34 of the upper enclosure 12 via the angled air holes 56. Alternatively, instead of through the exhaust pipe 92, the feed tube 110 can be inserted through the top cover 26 adjacent to the peripheral edge portion 26A thereof, such as at the location 112 shown in dashed outline in FIG. 1.

The support structure 22 of the apparatus 10, which supports the upper and lower enclosures 12, 14 in the upright tandem orientation as seen in FIGS. 1 and 2, includes a plurality of mounting braces 114, a support platform 116, a plurality of elongated leg members 118 and support actuators 120. The mounting braces 114 have substantially triangular shapes and are circumferentially spaced apart from one another. The mounting braces 114 are fixedly mounted in vertical orientations to upper annular sidewall 24 of the upper enclosure 12 at the exterior side 12A thereof and extend radially outwardly therefrom so as to overlie the support platform 116. The support platform 116 has a generally flat configuration and a central opening 116A. The attached upper and lower enclosures 12, 14 are received through the central opening 116A of the support platform 116 and the mounting braces 114 by resting upon the support platform 116 about its central opening 116A thereby support and retain the attached upper and lower enclosures 12, 14 in the upright tandem orientation. The leg members 118 having top and bottom ends 118A, 118B and are rigidly connected at their upper ends 118A to the support platform 116 at the respective corners 116B thereof so as to dispose the platform in a horizontal orientation and at a desired height above a support surface, such as the ground. Pairs of the leg members 118 at their bottom ends 118B may be interconnected by horizontal brace members 122 and rest on the support surface. Each of the support actuators 120 can be any suitable conventional type, such as ones manually, mechanically, pneumatically or hydraulically operated. Each actuator 120 is mounted to the top cover 26 of the upper enclosure 12 and extends upright therefrom and is connected at corners of a bracket arrangement 124 surrounding and extending outwardly from the exhaust pipe 92. The actuators 120 can be actuated so as to selectively raise and lower the exhaust pipe 92, via the bracket arrangement 124, relative to the top cover 26 to different positions relative to the upper enclosure 12 and thus to extend to different depths within the upper interior chamber 34 of the upper enclosure 12.

The upper interior chamber 34 of the upper enclosure 12 receives from a suitable external source, via the feed tube 110, diverse materials to be ground, such as glass, grain, paper, plastic, aluminum, granite and the like. The upper interior chamber 34 also receives, via the angled air holes 56 in the upper annular sidewall 24, the flow of air in compressed state that interacts with the material as the latter is received in the upper interior chamber 34 of the upper enclosure 12. The angle of each of the air holes 30 is selected to cause the compressed air to flow at high velocity in one of a clockwise or counterclockwise direction in the upper interior chamber 34 such that the compressed air, by its high velocity, causes forceful impacts on the material which result in the reduction and grinding of the material into small sizes within the upper interior chamber 34. The lower interior chamber 36 of the lower enclosure 14 which is continuous and in flow communication with the upper interior chamber 34 of the upper enclosure 12 has a substantially inverted conical configuration that augments the creation and maintenance of the circular vortex flow of air within the upper and lower interior chambers 34, 36 of the upper and lower enclosures 12, 20 that facilitates the grinding of the material therein. The material ground in the upper interior chamber 34 falls or descends into the lower interior chamber 36 and downward therethrough along the lower annular sidewall 30 of the lower enclosures 14 toward and out the open lower end 30B thereof, as shown in FIG. 2. The circular vortex flow creates a vacuum in the center of each of the upper and lower interior chambers 34, 36 of the upper and lower enclosures 12, 14 which allows the ground material to fall downward through the lower interior chamber 36 and out the lower end 30B of the lower annular sidewall 30 of the lower enclosure 14 while excess air flows from the upper and lower interior chambers 34, 36 upward through the exhaust pipe 92. A vacuum condition is also present in the feed tube 110 which tends to draw the material to be processed into the upper interior chamber 34 of the upper enclosures 12. Concurrently, with the grinding of the material by the apparatus 10 it is also dried therein. The sizes of the upper and lower enclosures 12, 14 as well as the other components of the apparatus 10 can vary depending upon the type of material to be ground and the capacity needed. The apparatus 10 illustrated in the drawings is but one exemplary embodiment.

The compressed air introduced into the upper interior chamber 34 of the upper enclosure 12 may have a preselected pressure that falls within a wide range of from about 10 to about 600 pounds per square inch (psi). The compressed air may have a velocity that falls within a wide range of from about 5 to about 12,000 cubic feet per minute (cfm). The compressed air also may have a temperature which may be varied. The temperature of the compressed air may be raised, such as by use of a heat exchanger unit (not shown) or the like, to enhance the grinding and drying of the material. The temperature of the air may fall within a wide range of about 40° F. to about 900° F. Steam can also be used to heat the compressed air. The steam may be at a temperature falling within a wide range of about 212° F. to 2000 °F. This will greatly enhance the drying process as well as increase the shearing force of the compressed air. Steam may also be used to operate the apparatus 10 at a specific pressure, temperature and cubic feet per minute.

It is also possible to use cooled air, such as air which has been cooled to below freezing temperatures, to retain certain elements in the finished product. For example, liquid nitrogen, carbon dioxide, cooling vortex tubes, refrigeration equipment and/or underground or surface water could be used to cool the air. Also a suitable flow of air can be delivered at the velocity, pressure and temperature required, by other known techniques than compression of the air, to operate the apparatus 10. The variation of the air in terms of its velocity, pressure and temperature depends on the type of material being processed and size of the apparatus 10.

The exact mechanism that causes the grinding and reduction of the material within the apparatus 10 is not known. Several different theories of its operation are that the grinding results from the pieces of material forcefully colliding with each other or the centrifugal force of the vortex moving the material forcefully against the upper and lower annular sidewalls 24, 30 of the upper and lower enclosures 12, 14 or the difference of pressure and vacuum causing the material to loose unity or integrity or to implode. It has been noted that when the apparatus 10 is in operation, the center of the vortex has dead air (low pressure) space from the lower end 92B of the exhaust pipe 92 to the exit or lower end 30B of the lower annular sidewall 30 of the lower enclosure 14. Another dead air (low pressure) space is found along the interior of the sidewall 30 of the lower enclosure 14 allowing the processed material to drop down to the bottom of the lower interior chamber 36 and exit the lower enclosure 14. A vacuum is formed between the dead air in the center of the apparatus 10 and the dead air space along the perimeter of the lower enclosure 14.

INDUSTRIAL APPLICABILITY

The apparatus 10 is designed to efficiently and easily grind, dry and dehydrate diverse materials. As described in more detail below, the apparatus 10 has many practical applications which include, but are not limited to, the grinding, drying and pasteurization of animal or agricultural products, the grinding of industrial waste cleanup, the recycling of consumer waste, desalination of salt water, the grinding of fuels for more efficient burning, and the grinding of medical products for more efficient delivery. The drying, dehydrating and grinding characteristics of the apparatus 10 appears to be a cost-effective supplement or replacement of conventional spray drying operations. The apparatus 10 also appears capable of being downsized to provide small grinders and dryers for use in a household with consumer products.

Pasteurization. The temperature of the air at 150° F. or higher and the pulverizing effect of the colliding particles combine to produce a uniquely efficient pasteurization process. Liquid egg, a byproduct of the hatchery and egg breaking industry, can be reduced to a powder, even though the solid content of the liquid egg is only about 18% to 20%. The powder seems to have a pleasant odor and good shelf life. The moisture content of the powder averages from 1% to 4%.

Agricultural Products. All types of grains can be ground into flour and dried in the same operation. The mill wastes from the grain can then be ground into a fine powder, making more of the nutrients available so it can then be utilized in feed products. Water plants, such as algae, seaweed, duckweed and other plant life, can be dried and ground at low temperatures thereby preserving their nutritional value. Herbs can be ground into a fine powder potentially increasing their potency.

Animal Product. Many shellfish and marine life products, such as crab, lobster, shrimp, oyster, etc., can be ground and dried to better utilize the byproducts of processing plants. The shells, a byproduct of processing, can be dried and ground into a fine powder that makes extraction of products such as chitin more feasible. Most of the shellfish shells can be ground to the micron size desired enhancing the interaction with different elements.

Various animal wastes as well as byproducts from animal processing plants can be ground and dried. Animal wastes, such as hen manure from commercial layer houses, can be dried and ground to produce a fertilizer-grade product. D.A.F., a waste product from animal processing plants, can be dried and ground. This material has good protein content and can be used in animal feeds. D.A.F. contains a high bacteria content, but through the use of the apparatus 10, the bacteria reproduction in some cases was reduced or eliminated. Poultry products such as eggshells from hatcheries and egg breaking plants can be ground and dried. Eggshell can be better utilized by grinding the shell into a fine powder. The membranes from the inside of the shell having a high content of collagen will remain in large particles. These can then be easily removed from the calcium with the use of a screen. Both membrane and calcium can be dried and ground to the desired size.

Industrial Waste Cleanup. The apparatus 10 can be used to grind high fracture materials such as coal, concrete, aluminum, glass, wood, paper, hard plastics, rock, limestone, mineral ores, etc. Its grinding-drying motion and dehydrating can be used on contaminated soils as well as industrial and hazardous wastes. Pollution prevention and waste reduction goals of EPA regulations can be addressed by this apparatus.

Moreover, certain materials may be rendered more valuable, effectuated by the reduction of volume. For example, filter cakes are mostly water. If the water is removed, the remaining materials, chromium, nickel, tin, iron, etc., effectively become more concentrated and thus have value. The process of extracting and recycling them, then, may become more economically feasible.

Further, the possibility for element extraction exists, even with the simultaneous application of this technology. Element extraction is based on specific atomic gravity of each element found in its own strata in the vortex after the initial grinding has taken place. Extraction should be relatively simple once the elements are located.

Industrial byproducts can be reduced in volume and moisture content, reducing freight costs and storage requirements. Sewage waste and sludge can be dried, reducing the volume. The technology's characteristics of heated air and vortex air velocity will likely prove to be very effective in remediating hydrocarbon contaminated soils (halogenated and non-halogenated), especially those that are regulated via the Resource Recovery Act (RCRA). Through an accelerated volatilization of the hydrocarbons they may be recovered in another stage, condensed into pure products and sold as such. The remediated soil may then be back-filled.

Consumer Waste Recycling. Many consumer products can be separated into their components, ground and dried, and then recycled. Glass can be processed into a fine powder or silica. Glass products having labeling on them can be processed without removing the labels. The paper or labels will remain in larger pieces and can be easily removed from the silica with the use of a screen. Other products, for example baby diapers, can be separated and dried, enabling the recycling of the components that can be recycled, and reducing the volume of the wastes that must be deposited in landfills.

Freshwater Creation. The apparatus 10 has the potential to desalinate seawater. Ionization is possible for use of separation and processing of materials.

Cleaner Burning Fuels. The apparatus 10 may have the ability to grind fuels such as coal into micro particles that may be burned more efficiently, with reduced pollution.

Medical and Pharmaceuticals. The ability to grind particles to microscopic sizes may have the ability to render drugs, vitamins and minerals more available to humans and animals.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

What is claimed is:

1. A material grinding apparatus, comprising:

(a) an upper enclosure including an upper annular sidewall and having an upper end, open lower end and opposite exterior and interior sides, said upper annular sidewall defining an upper interior chamber at said interior side of said upper enclosure and having at least one hole of a predetermined size formed through said upper annular sidewall between said exterior and interior sides of said upper enclosure so as to provide flow communication between said exterior side of said upper enclosure and said upper interior chamber thereof;

(b) a lower enclosure disposed below and in a tandem arrangement with said upper enclosure, said lower enclosure including a lower annular sidewall having a substantially inverted conical configuration and open upper and lower ends and defining a lower interior chamber, said lower annular sidewall of said lower enclosure being mounted at said open upper end thereof to said upper annular sidewall at said open lower end of said upper enclosure such that said lower annular sidewall and lower interior chamber of said lower enclosure are substantially continuous and in flow communication with said upper annular sidewall and upper interior chamber of said upper enclosure;

(c) means for delivering material to be ground into said upper interior chamber of said upper enclosure through said upper end of said thereof;

(d) means for supplying a flow of air through said hole in said upper annular sidewall of said upper enclosure into said upper interior chamber thereof to along a flow path extending about said interior side of said upper enclosure;

(e) one or more deflection plates, mounted to said interior side of said upper enclosure adjacent to said one or more holes through said upper annular sidewall defining an angular configuration relative to said upper annular sidewall, for deflecting air circulating within the upper interior chamber away from said one or more holes so that air circulating withing the upper interior chamber does not disrupt air flowing from said one or more holes into said upper interior chamber; and (f) means for exhausting air from said upper interior chamber of said upper enclosure through said upper end thereof such that said means for supplying air and said means for exhausting air coact with said hole in said upper annular sidewall and with said upper and interior chambers of said upper and lower enclosures to create a circular vortex flow of air within said upper and lower interior chambers of said upper and lower enclosures that causes grinding and drying of material substantially in said upper interior chamber of said upper enclosure, upward discharge of air from said upper interior chamber through said upper end thereof, downward travel of ground material through said lower interior chamber of said lower enclosure and downward discharge of the ground material from said lower interior chamber through said open lower end of said lower enclosure, said lower interior chamber of said lower enclosure having an inverted conical shape which augments said circular vortex flow of air and material in said upper and lower interior chambers of said upper and lower enclosures.

2. The apparatus of claim 1 further comprising:

a support structure supporting said upper and lower enclosures in an upright orientation with said upper enclosure above said lower enclosure such that said upper and lower enclosures and said upper and lower interior chambers thereof are in a tandem orientation with one another.

3. The apparatus of claim 1 wherein said hole through said upper annular sidewall of said upper enclosure is a slot having a height oriented so as to extend between and in a generally transverse relationship to said upper and lower ends of said upper enclosure.

4. The apparatus of claim 1 wherein said hole through said upper annular sidewall of said upper enclosure is a slot having a length oriented so as to extend between and at an acute angle relative to said exterior and interior sides of said upper enclosure.

5. The apparatus of claim 1 wherein said upper enclosure further includes means for adjusting said size of said hole through said upper annular sidewall of said upper enclosure.

6. The apparatus of claim 5 wherein said means for adjusting said size of said hole includes a plate and a releasable fastening arrangement mounting said plate to said upper annular sidewall at said exterior side of said upper enclosure adjacent to said hole through said upper annular sidewall for undergoing slidable movement in relation to said upper annular sidewall and said hole therethrough for varying the effective size of said hole through which said flow of air can pass.

7. The apparatus of claim 1 wherein said means for supplying air provides the air in a compressed state.

8. The apparatus of claim 1 wherein said means for supplying air includes:

a manifold mounted to said upper annular sidewall of said upper enclosure on said exterior side thereof and defining an air collection cavity enclosing and disposed in flow communication with said hole through said upper annular sidewall, said manifold having an air supply inlet; and at least one tube extending from an external source of air and being connected to and in flow communication with said air supply inlet of said manifold such that the flow of air passes through said tube, through said air supply inlet of said manifold, into and through said air collection cavity of said manifold, through said hole of said upper enclosure and into said upper interior chamber of said upper enclosure.

9. A material grinding apparatus, comprising:

(a) an upper enclosure including an upper annular sidewall and having an upper end, open lower end and opposite exterior and interior sides, said upper annular sidewall defining an upper interior chamber at said interior side of said upper enclosure and having a plurality of slots each of a predetermined size formed through said upper annular sidewall between said exterior and interior sides of said upper enclosure and being circumferentially spaced apart from one another about said upper annular sidewall and being oriented so as to extend between and at an acute angle relative to said exterior and interior sides of said upper enclosure such that said slots provide flow communication between said exterior side of said upper enclosure and said upper interior chamber thereof at spaced apart locations on said upper enclosure;

(b) a lower enclosure disposed below and in a tandem arrangement with said upper enclosure, said lower enclosure including a lower annular sidewall having a substantially inverted conical configuration and open upper and lower ends and defining a lower interior chamber, said lower annular sidewall of said lower enclosure being mounted at said open upper end thereof to said upper annular sidewall at said open lower end of said upper enclosure such that said lower annular sidewall and said lower interior chamber of said lower enclosure are substantially continuous and in flow communication with said upper annular sidewall and said upper interior chamber of said upper enclosure;

(c) means for delivering material to be ground into said upper interior chamber of said upper enclosure through said upper end thereof;

(d) means for supplying a flow of air through said slots in said upper annular sidewall of said upper enclosure into said upper interior chamber thereof to along a flow path extending about said upper annular sidewall at said interior side of said upper enclosure;

(e) one or more deflection plates, mounted to said interior side of said upper enclosure adjacent to said one or more slots in said upper annular sidewall defining an angular configuration relative to said upper annular sidewall, for deflecting air circulating within the upper interior chamber away from said one or more slots so air circulating within the upper interior chamber does not disrupt air flowing from said one or more slots into said upper interior chamber; and (e) means for exhausting air from said upper interior chamber of said upper enclosure through said upper end thereof such that said means for supplying air and said means for exhausting air coact with said slots in said upper annular sidewall and with said upper and interior chambers to create a circular vortex flow of air within said upper and lower interior chambers of said upper and lower enclosures that causes grinding and drying of material substantially in said upper interior chamber of said upper enclosure, upward discharge of air from said upper interior chamber of said upper enclosure through said upper end thereof, downward travel of ground material through said lower interior chamber of said lower enclosure and discharge of the ground material from said lower interior chamber through said open lower end of said lower enclosure, said lower interior chamber of said lower enclosure having an inverted conical shape which augments said circular vortex flow of air and material in said upper and lower interior chambers of said upper and lower enclosures.

10. The apparatus of claim 9 further comprising:

a support structure supporting said upper and lower enclosures in an upright orientation with said upper enclosure above said lower enclosure such that said upper and lower enclosures and said upper and lower interior chambers thereof are in a tandem orientation with one another.

11. The apparatus of claim 9 wherein each of said slots through said upper annular sidewall of said upper enclosure has a height oriented so as to extend between and in a generally transverse relationship to said upper and lower ends of said upper enclosure.

12. The apparatus of claim 9 wherein said upper enclosure further includes means for adjusting said size of each of said slots through said upper annular sidewall of said upper enclosure.

13. The apparatus of claim 12 wherein said slot size adjusting means includes a plate and a releasable fastening arrangement mounting said plate to said upper annular sidewall at said exterior side of said upper enclosure adjacent to each of said slots through said upper annular sidewall for undergoing slidable movement in relation to said upper annular sidewall and said slot therethrough for varying the effective width of said slot through which said flow of air can pass.

14. The apparatus of claim 9 wherein said means for supplying air provides the air in a compressed state.

15. The apparatus of claim 9 wherein said means for supplying air includes:

a plurality of manifolds each mounted to said upper annular sidewall of said upper enclosure on said exterior side thereof and defining an air collection cavity enclosing and disposed in flow communication with one of said slots through said upper annular sidewall, each of said manifolds having an air supply inlet; and a plurality of tubes extending from an external source of compressed air and being connected to and in flow communication with said air supply inlets of said manifolds such that air in the compressed state passes through said tubes, through said air supply inlets of said manifolds, into and through said air collection cavities of said manifolds, through said slots of said upper enclosure and into said upper interior chamber of said upper enclosure.

16. The apparatus of claim 15 wherein said means for exhausting air from said upper interior chamber of said upper enclosure includes an exhaust pipe having an open upper end and an open lower end and being mounted to and disposed through said upper end of said upper enclosure such that said open upper end of said exhaust pipe is disposed externally of and above said upper enclosure and said open lower end of said exhaust pipe is disposed within and in flow communication with said upper interior chamber of said upper enclosure, said open lower end of said exhaust pipe being located closer to said open lower end of said upper enclosure than to said upper end thereof.

17. The apparatus of claim 16 wherein said upper end of said upper enclosure includes a top cover having a substantially central opening.

18. The apparatus of claim 16 wherein:

said exhaust pipe also has an upper side opening disposed externally of and above said upper enclosure and a lower side opening disposed within and in flow communication with said upper interior chamber of said upper enclosure; and said means for delivering material to be ground into said upper interior chamber of said upper enclosure includes a feed tube having an open upper end and an open lower end and being mounted to and disposed through said upper and lower sides openings of said exhaust pipe such that said open upper end of said feed tube is disposed externally of said upper enclosure and adjacent to a side of said exhaust pipe and said open lower end of said feed tube is disposed internally of said upper enclosure and adjacent to an opposite side of said exhaust pipe and within and in flow communication with said upper interior chamber of said upper enclosure such that material to be ground can be fed via said feed tube across said exhaust pipe from exteriorly of said upper enclosure into said circular vortex flow of air in said upper interior chamber of said upper enclosure.

19. The apparatus of claim 16 wherein each of said slots through said upper annular sidewall of said upper enclosure has a height oriented so as to extend between and in a generally transverse relationship to said upper and lower ends of said upper enclosure.

20. The apparatus of claim 16 further comprising:

a damper movably mounted to said exhaust pipe and being adjustable to regulate the flow of air from said upper interior chamber of said upper enclosure through said exhaust pipe and thereby regulate the size to which the material is ground in said upper interior chamber of said upper enclosure.

21. A material grinding apparatus, comprising:

(a) an upper enclosure comprising an upper annular sidewall, an upper end, an open lower end an exterior and interior sides, said interior side of said upper enclosure defining an upper interior chamber, where one or more holes are formed through said upper annular sidewall;

(b) a lower enclosure disposed below said upper enclosure, said lower enclosure comprising a lower annular sidewall having a substantially inverted conical configuration, exterior and interior sides and open upper and open lower ends, said interior side of said lower enclosure defining a lower interior chamber, said lower enclosure being mounted at its open upper end to said upper enclosure at its open lower end such that said lower interior chamber is substantially continuous with said upper interior chamber;

(c) a feed tube for delivering material into said upper enclosure;

(d) an air supply tube for supplying a flow of air through said one or more holes in said upper annular sidewall of said upper enclosure into said upper interior chamber;

(e) one or more deflection plates, mounted to said interior side of said upper enclosure adjacent to said one or more holes in said upper annular sidewall and defining an angular configuration relative to said upper sidewall, for deflecting air circulating within the upper interior chamber away from said one or more holes so that air circulating within the upper interior chamber does not disrupt air flowing from said one or more holes into said upper interior chamber; and (f) an exhaust pipe for exhausting air from said upper interior chamber of said upper enclosure through said upper end of said upper enclosure, wherein said air supply tube and said exhaust pipe coact with said one or more holes and with said upper and lower interior chambers to create a vortex flow of air within said upper and lower interior chambers sufficient to grind, dry and dehydrate materials, upwar discharge of air and downward travel and discharge of the ground material.

22. The apparatus of claim 21 further comprising:

a support structure supporting said upper and lower enclosures in an upright orientation with said upper enclosure above said lower enclosure such that said upper and lower enclosures and said upper and lower interior chambers thereof are in a tandem orientation with one another.

23. The apparatus of claim 21 wherein each hole through said upper annular sidewall of said upper enclosure is a slot having a height oriented so as to extend between and in a generally transverse relationship to said upper and lower ends of said upper enclosure.

24. The apparatus of claim 21 wherein each hole through said upper annualr sidewall of said upper enclosure is a slot having length oriented so as to extend between and at an acute angle relative to said exterior and interior sides of said upper enclosure.

25. The apparatus of claim 21 wherein said upper enclosure further comprises one or more adjustable plates, mounted on said exterior side of said upper enclosure adjacent to each hole in said upper annular sidewall, for varying the effective size of each hole.

26. The apparatus of claim 21 wherein said air supply tube provides air in a compressed state.

27. The apparatus of claim 21 wherein said air supply tube comprises the following components:

a manifold mounted to said upper annular sidewall of said upper enclosure on said exterior side thereof and defining an air collection cavity enclosing said one or more holes through said upper annular sidewall, said manifold having an air supply inlet; and at least one tube extending from an external source of air and being connected to said air supply inlet of said manifold such that the flow of air passes through said tube, through said air supply inlet of said manifold, into and through said air collection cavity of said manifold, through at least one of said holes of said upper enclosure and into said upper interior chamber of said upper enclosure.

28. A material grinding apparatus, comprising:

(a) an upper enclosure comprising an upper annular sidewall, an upper end, an open lower end and exterior and interior sides, said interior side of said upper enclosure defining an upper interior chamber, where a plurality of slots are formed through said upper annular sidewall which are circumferentially spaced apart from one another about said upper annular sidewall and oriented to extend between and at an acute angle relative to said exterior and interior sides;

(b) a lower enclosure disposed below said upper enclosure, said lower enclosure comprising a lower annular sidewall having a substantially inverted conical configuration, exterior and interior sides and open upper and open lower ends, said interior side of said lower enclosure defining a lower interior chamber, said lower enclosure being mounted at its open upper end to said upper enclosure at its open lower end such that said lower interior chamber is substantially continuous with said upper interior chamber;

(c) a feed tube for delivering material into said upper interior chamber of said upper enclosure;

(d) an air supply tube for supplying a flow of air through said slots in said upper annular sidewall into said upper interior chamber;

(e) one or more deflection plates, mounted to said interior side of said upper enclosure adjacent to said one or more slots in said upper annular sidewall and defining an angular configuration relative to said upper annular sidewall, for deflecting air circulating within the upper interior chamber away from said one or more slots so that air circulating within the upper chamber does not disrupt air flowing from said one or more slots into said upper interior chamber; and (f) an exhaust pipe for exhausting air from said upper interior chamber of said upper enclosure through said upper end of said upper enclosure, wherein said air supply tube and said exhaust pipe coact with said slots and said upper and lower interior chambers to create a vortex flow of air within said upper and lower interior chambers that causes grinding, drying and dehydration of material, upward discharge of air and downward travel and discharge of the ground material.

29. The apparatus of claim 28 further comprising:

a support structure supporting said uper and lower enclosures in an upright orientation with said upper enclosure above said lower enclosure such that said upper and lower enclosures and said upper and lower interior chambers thereof are in a tandem orientation with one another.

30. The apparatus of claim 28 wherein each of said slots throug said upper annular sidewall of said upper enclosure has a height oriented so as to extend between and in a generally transverse relationship to said upper and lower ends of said upper enclosure.

31. The apparatus of claim 28 wherein said upper enclosure further comprises one or more adjustable plates, mounted on said exterior side of said upper enclosure adjacent to each slot in said upper annular sidewall, for varying the size of each slot.

32. The apparatus of claim 28 wherein said air supply tube provides the air in a compressed state.

33. The apparatus of claim 28 wherein said air supply tube comprises the following components:

a plurality of manifolds each mounted to said upper annular sidewall of said upper enclosure on said exterior side thereof and defining an air colleciton cavity enclosing one of said slots through said upper annular sidewall, each of said manifolds having an air supply inlet; and a plurality of tubes extending from an external source of compressed air and being connected to said air supply inlets of said manifolds such that air in the compressed state passes through said tubes, through said air supply inlets of said manifolds, into and through said air collection cavities of said manifolds, through said slots of said upper enclosure and into said upper interior chamber of said upper enclosure.

34. The apparatus of claim 28 wherein said exhaust pipe has an open upper and an open lower end and is mounted to and disposed through said upper end of said upper enclosure such that said open upper end of said exhaust pipe is disposed externally of and above said upper enclosure and said open lower end of said exhaust pipe is disposed within said upper interior chamber of said upper enclosure, said open lower end of said exhaust pipe being located closer to said open lower end of said upper enclosure than to said upper end thereof.

35. The apparatus of claim 34 wherein said upper end of said upper enclosure includes a top cover having substantially central opening.

36. The apparatus of claim 34 wherein:

said exhaust pipe also has an upper side opening disposed externally of and above said upper enclosure and a lower side opening disposed within isaid upper interior chamber of said upper enclosure; and said feed tube has an open upper end and an open lower end and is mounted to and disposed through said upper and lower sides openings of said exhaust pipe such that said open upper end of said feed tube is disposed externally of said upper enclosure and adjacent to a side of said exhaust pipe and said open lower end of said feed tube is disposed internally of said upper enclosure and adjacent to an opposite side of said exhaust pipe and within said upper interior chamber of said upper enclosure such that material to be ground can be fed via said feed tube across said exhaust pipe from exteriorly of said upper enclosure into said circular vortex flow of air in said upper interior chamber of said upper enclosure.

37. The apparatus of claim 28 wherein each of said slots through said upper annular sidewall of said upper enclosure has a height oriented so as to extend between and in a generally transverse relationship to said upper and lower ends of said upper enclosure.

38. The apparatus of claim 28 further comprising;

a damper movably mounted to said exhaust pipe and being adjustable to regulate the flow of air from said upper interior chamber of said upper enclosure through said exhaust pipe and thereby regulate the size to which the material is ground in said upper interior chamber of said upper enclosure.

39. A material grinding method, comprising the steps of:

(a) providing an upper enclosure with an interior side and an exterior side, said interior side defining an interior chamber, with one or more holes formed between the exterior and interior sides and oriented so as to extend between and at an acute angle relative to the exterior and interior sides;

(b) providing a lower enclosure below and in tandem with the upper enclosure and having an inverted conical configuration such that lower interior chamber of the lower enclosure is substantially continuous with the upper interior chamber of the upper enclosure;

(c) delivering material to be ground into the upper interior chamber of the upper enclosure through an upper end of the upper enclosure;

(d) supplying a flow of air through the hole or holes in the upper enclosure into the upper interior chamber thereof;

(e) deflecting the flow of air circulating within the upper enclosure away from said one or more holes so that air circulating within the upper enclosure does not disrupt air flowing from said one or more holes into said upper enclosure, using one or more deflection plates mounted to said interior side of said upper enclosure adjacent to said one or more holes and defining an angular configuration relative to said interior side of said upper enclosure; and (f) exhausting air from the upper interior chamber of the upper enclosure through the upper end thereof such that the supplying and the exhausting of air coact with said one or more holes and the upper and interior chambers to create a vortex flow of air within the upper and lower interior chambers that causes grinding, drying and dehydration of material and downward travel and discharge of ground material.

40. The method of claim 39 wherein the air being supplied is in a compressed state.

41. The method of claim 39 wherein the air being supplied is at a temperature within the range of about 40° F. to about 900° F.

42. The method of claim 39 wherein the air being supplied is at a pressure within the range of from about 10 psi to about 600 psi.

43. The method of claim 39 wherein the air being supplied is at a velocity within the range of from about five cubic feet per minute to about 12,000 cubic feet per minute.

44. The method of claim 39 wherein the air being supplied contains steam having a temperature within the range of from about 212° F. to about 2000° F..

* * * * *

UNITED STATES PATENT AND TRADEMARK OFFICE

CERTIFICATE OF CORRECTION

PATENT NO. : 6,971,594 B1
DATED : December 6, 2005
INVENTOR(S) : Francis D. Polifka It is certified that error appears in the above-identified patent and that said Letters Patent is hereby corrected as shown below:

Column 13,
Line 49, replace “at least one hole” with -- one or more holes --.

Column 14,
Lines 2-3, delete “through said upper end of said thereof”.
Lines 4, 21, 57, 60, 65 and 66, replace “hole” with -- one or more holes --.
Line 15, replace “withing” with -- wihtin --.
Line 26, after “with said upper and” add -- lower --.

Column 15,
Lines 8 and 15, replace “hole” with -- one or more holes --.
Lines 50-51, delete “through said upper end of said thereof”.
Line 66, replace “(e)” with -- (f) --.

Column 16,
Line 3, after “with said upper and” add -- lower --.

Column 17,
Line 62, after “upper” add -- interior chamber of said upper --.

Column 18,
Line 17, replace “upwar” with -- upward --.
Line 34, replace “annualr” with -- annular --.

Column 19,
Line 46, replace “throug” with -- through --.

UNITED STATES PATENT AND TRADEMARK OFFICE

CERTIFICATE OF CORRECTION

PATENT NO. : 6,971,594 B1
DATED : December 6, 2005
INVENTOR(S) : Francis D. Polifka It is certified that error appears in the above-identified patent and that said Letters Patent is hereby corrected as shown below:

Column 20,
Line 21, replace "isaid" with -- said --.

Signed and Sealed this

Fourth Day of April, 2006

JON W. DUDAS
*Director of the United States Patent and Trademark Office*